United States Patent [19]

Lane

[11] 4,174,172

[45] Nov. 13, 1979

[54] CLEANING METHODS AND APPARATUS FOR A PHOTOCOPYING DEVICE

[75] Inventor: John N. Lane, Leighton Buzzard, England

[73] Assignee: Xerox Corporation, Stamford, Conn.

[21] Appl. No.: 845,696

[22] Filed: Oct. 26, 1977

[30] Foreign Application Priority Data

Dec. 17, 1976 [GB] United Kingdom ..... 52774/76

[51] Int. Cl.[2] ..... G03G 21/00; B08B 7/00

[52] U.S. Cl. ..... 355/15; 15/256.5; 134/6

[58] Field of Search ..... 355/3 R, 15; 118/652; 15/256.5, 256.51, 256.53; 134/6

[56] References Cited

U.S. PATENT DOCUMENTS

| | | | |
|---|---|---|---|
| 3,759,220 | 9/1973 | Saito et al. | 355/15 X |
| 3,843,407 | 10/1974 | Thorp | 355/15 X |
| 3,848,992 | 11/1974 | Smith | 15/256.51 X |
| 3,859,691 | 1/1975 | Katayama et al. | 355/15 X |

*Primary Examiner*—Fred L. Braun

*Attorney, Agent, or Firm*—Earl T. Reichert

[57] ABSTRACT

A method and apparatus for cleaning a surface. The surface is moved in one direction relative to a cleaning blade in engagement therewith. Rest periods are provided of no relative motion wherein the blade is moved out of contact with the surface at a first position during the period of no relative motion. The blade is returned to the surface at a second position downstream of the first position. In accordance with a different embodiment the blade is removed from the surface after the surface has stopped, and is returned to the surface before relative motion commences.

13 Claims, 4 Drawing Figures

CLEANING METHODS AND APPARATUS FOR A PHOTOCOPYING DEVICE

BACKGROUND OF THE INVENTION

This invention relates to cleaning material from a suppprt surface, such as an imaging surface of a photocopier. More particularly the invention relates to methods and apparatus in which a cleaning blade engages a surface to be cleaned and the surface is driven past the blade.

To facilitate a clear understanding of the invention it is to be understood that the expressions "upstream" and "downstream" used herein and in the claims have the following meanings. The expression "upstream" refers to that direction from which any point on a movable surface travels. The expression "downstream" refers to that direction towards which any point on a movable surface travels. A cleaning blade may be disposed normally to the surface to be cleaned or it may be tilted in leading or trailing relation to the direction of movement of the surface. Such tilted blades are generally referred to respectively as scraper and wiper blades. These expressions as used herein and in the claims are defined as follows. A "scraper blade" is one which extends towards the surface in the upstream direction and when pressed against the surface exerts a chiselling action on material on the surface. A "wiper blade" is one which extends toward the surface in the downstream direction.

It has been found desirable, for example, in the case of a plastics blade acting on a photosensitive surface to remove residual liquid developer therefrom, in the environment of a xerographic copier, to separate the blade from the surface during shut-down periods, as between copy cycles, to avoid cold flow resulting in deformation of one or both of the blade and the surface. When the blade is removed from the surface, particularly in the case of liquid, material which has piled up against the blade will tend to spread out beyond the blade position when the support from the blade is removed. In an effort to alleviate this problem it is proposed in U.S. Pat. No. 3,940,282 to Hwa, that before each shut-down period, the relative motion between the blade and the surface is reversed prior to removing the blade from the surface. Such reversal of relative motion tends to break up and remove the build-up of material.

SUMMARY OF THE INVENTION

From one aspect, the present invention consists in a method of cleaning a surface by moving the surface in one direction relative to a cleaning blade in engagement therewith with rest periods of no relative motion wherein said blade is moved out of contact with the surface at a first position during a said period of no relative motion and returned thereto at a second position downstream of said first position.

It is to be understood that so long as the blade is returned to the surface at a position downstream of the position at which it is removed, removal may be effected to correspond with cessation of motion of the surface or just before or after. Similarly, return of the blade to engagement with the surface may correspond with restart of the surface or it may occur just before or after restart.

It has also been found that with blade cleaning systems the build-up of the material being removed and also of contaminants, such as dust, will affect its cleaning seal with the surface. In order to reduce this problem it is a preferred feature of this invention to reverse the relative motion of the blade and surface prior to removal of the blade from the surface. This may be achieved by reversing the motion of the surface for cleaning or by moving the blade across the surface in the downstream direction before moving it out of contact with the surface. During this movement the blade may be pressed against the surface so as to flex the cleaning edge thereof out of contact with the surface.

While this invention has broad application to the cleaning of surfaces in general, it is particularly suitable for use in cleaning photosensitive surfaces in electrostatographic reproduction machines and from another aspect the invention consists in an electrostatographic reproduction method comprising forming a latent electrostatic image on a moving support surface, developing the latent image with developer, transferring the developed image on to support material and cleaning the remaining materials from the surface as set out hereinabove.

From a further aspect, the invention consists in apparatus for cleaning a surface including a cleaning blade engageable with said surface, drive means for moving the surface past the cleaning blade with rest periods of no relative motion, and blade translation means for moving the blade out of contact with the surface at a first position during a said period of no relative motion and for returning the blade into engagement with the surface at a second position downstream of said first position.

In a preferred embodiment, a blade translation mechanism is provided by which the blade is moved across the surface before being removed from the surface. Means are provided for moving the blade relative to the surface and the blade is guided during such movement by a cam which is engaged by a follower which is fixed with respect to the blade. The cam is pivotally mounted intermediate its ends, e.g., at the center, and the follower is biased against the cam such that the cam is urged to a first position in which the blade is engaged with the surface when the follower is to one side of the pivot and is urged to a second position in which the blade is disengaged from the surface when the follower is to the other side of the pivot. A solenoid is provided which is operable to override the biasing action of the follower and move the cam from said second to said first position.

In order that the invention, and in particular the operation of the preferred embodiment described in general terms above, may be more readily understood, reference will now be made to the accompanying drawings.

DETAILED DESCRIPTION

Figure 1:
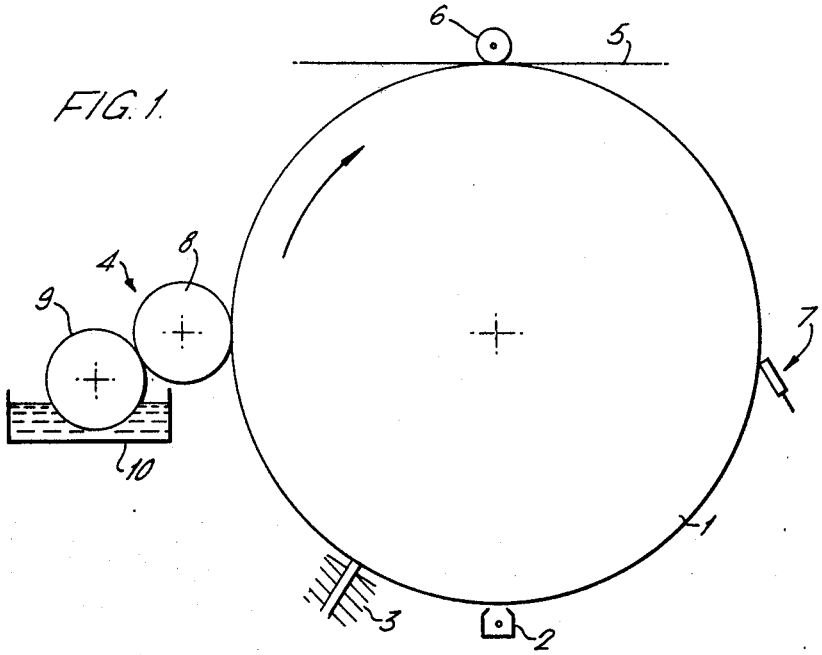
FIG. 1 is a schematic cross-section illustrating the operation of one embodiment of electrostatographic reproduction machine utilizing the cleaning techniques of this invention.

Referring to the drawings, the general operation of an electrostatographic machine as illustrated will first be described with reference to FIG. 1. A moving photoconductive plate, in this instance having an endless surface constituting the periphery of a drum 1, is first uniformly charged at a charging station 2 and the surface then exposed at an exposure station 3 to a light pattern of the image sought to be reproduced thereby to discharge the charge in the area where light strikes the plate surface. The undischarged areas of the surface thus form an electrostatic charge pattern in conformity with the configuration of the original image pattern.

The electrostatic latent image is developed into visible form by the development system 4 by applying liquid developer material to the plate. Subsequent to the development operation the now visible image is transferred from the plate to a sheet of final support material 5, such as paper or the like, thereby to form a permanent print, at a transfer station in accordance with the present invention schematically illustrated at 6. The paper or the like is fed to the transfer station by means (not shown) programmed to deliver the paper in synchronism with the arrival of the developed image.

The development system of the illustrated embodiment employs the techniques described in U.S. Pat. No. 3,084,043 in which the liquid developer is applied to the plate by means of an applicator, in this embodiment in the form of a roll 8 having a peripheral surface comprising lands and valleys such that the liquid developer is contained in the valleys out of contact with the plates, while the surface of the lands are in contact with the plate. In such an arrangement the liquid developer is attracted from the valleys to the electrostatic latent image in image configuration. The illustrated embodiment exemplifies a typical example of such an arrangement in which the applicator is a rigid cylindrical member 8 having on its surface a pattern of grooves and ridges which comprise the lands and valleys respectively, the liquid developer being maintained in the valleys below the surface of the lands.

As a plate surface bearing the electrostatic latent image and the applicator are brought into moving contact, the liquid developer is drawn to the plate surface from the valleys of the applicator roll by the charges which form the electrostatic latent image.

The applicator roll 8 is supplied with liquid developer by a developer supply roll 9 the lower portion of which is disposed in a tray 10 containing liquid developer. The surface of the developer supply roll 9 is arranged in liquid transfer relationship with the peripheral surface of the applicator roll 8 which latter is, in operation, arranged in pressure contact with the surface of the drum 1. Means are provided for driving both of the rolls 8 and 9 in synchronism, or substantially so, with the drum 1. Following transfer, residual developer remaining on the plate surface is removed by a cleaning blade 7 and collected for subsequent disposal. The cleaning blade shown is a scraper blade which is arranged on the downhill or downwardly moving side of the drum 1. The blade may in another arrangement be arranged on the uphill side of the drum as shown for example in FIGS. 2 to 4.

Figure 2:
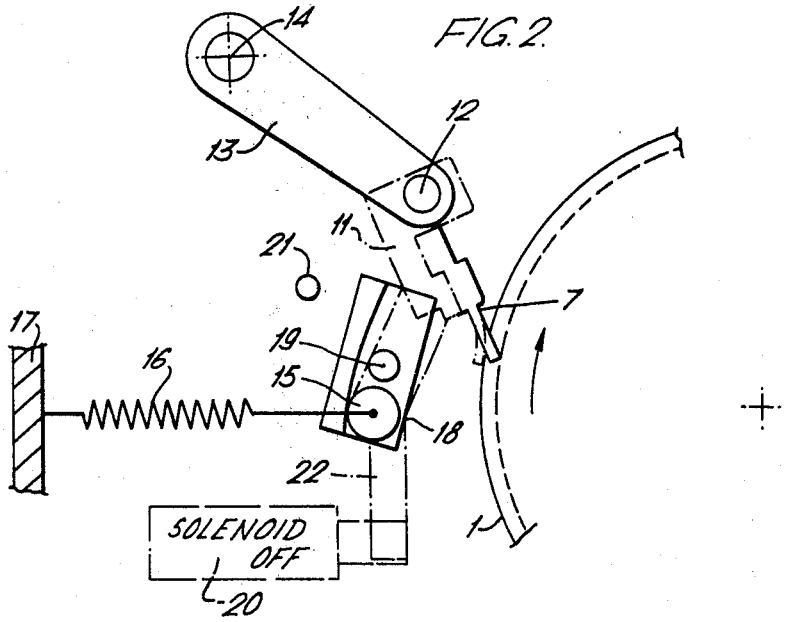
FIG. 2 is a schematic cross-section illustrating a preferred embodiment of blade translating mechanism for performing the cleaning techniques of the invention showing the blade in its normal cleaning position.
Figure 3:
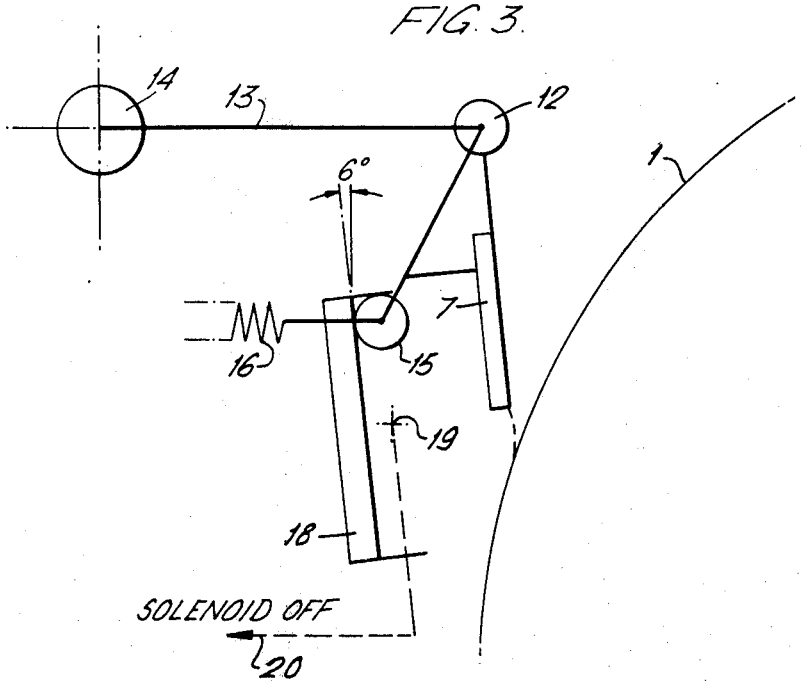
FIG. 3 is a view like that of FIG. 2 showing the blade raised from the surface.
Figure 4:
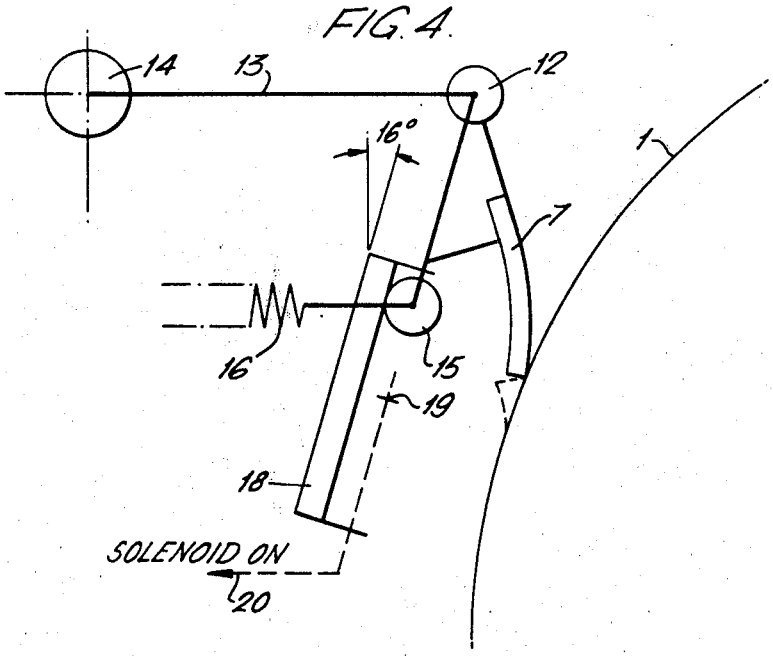
FIG. 4 is a view like that of FIGS. 2 and 3 showing the blade in its position when returned to the surface.

Referring now to FIGS. 2 to 4 there is illustrated a blade translation mechanism in which the blade 7 is supported in a mounting 11 which is freely pivotally supported on a shaft 12 connected between a pair of suspension arms 13 (only one of which is visible). The arms 13 are themselves mounted on a programmer shaft 14 for rotation therewith. The shaft 14 is operated by a cam or other means (not shown) controlled by the machine logic to translate the blade upstream along the drum surface 1 between end positions in timed relation to the operation of the machine. The blade mounting 11 carries a roller follower 15 which is spring loaded (by a tension spring 16 connected to the machine frame 17) against a track member 18 for guiding the blade during movement along the photoreceptor surface. The track 18 is pivoted at its centers on pivot 19 for angular movement between limits defined respectively by the rest position of a solenoid 20 connected to the track, and a stop 21. The solenoid 20 is connected to the track 18 by a lever 22 and when activated urges the track into the position shown in FIG. 2.

The machine logic controls the shaft 14 to operate the blade in the following manner:

(a) At the end of a copy making cycle (following the making of one or a plurality of copies) when the drum is stationary, or as it comes to a rest, to apply a uniform pressure reverse wipe on the photoreceptor for a short distance and then retract the blade to a park position out-of-contact with the photoreceptor;

(b) At the start of a cycle, to return the cleaning blade to the photoreceptor in a position ahead of the parking line before the photoreceptor is moving, or as it begins to move.

The above operation is achieved by the illustrated embodiment in the following way. In the normal cleaning mode as shown in FIG. 2, the drum rotating clockwise, the track 18 is biased to a clockwise position by the follower 15 and the blade is against the photoreceptor 1. (As shown diagrammatically in FIG. 1 the blade is desirably in an interference relationship, e.g., of 2 mm, with the surface 1, the blade being deflected by the surface to a curved configuration as shown in broken lines). As the shaft 14 is rotated at the end of a copying cycle, after the drum 1 has stopped moving, the follower 15 rides along track 18 to cause the blade 7 to wipe in the downstream or reverse direction along the drum surface. This has the desirable effect of releasing developer and contaminants, such as dust, which may have built up underneath the blade and be affecting its cleaning seal with the photoreceptor.

As the follower 15 passes the pivot 19, it causes the track 18 to rotate anti-clockwise retracting the blade from the surface 1 to a park position as shown in FIG. 3. As illustrated, the blade edge may be spaced 2.5 mm from the photoreceptor in its park position. The blade remains in the park position until the machine logic is actuated to start another copy cycle.

Actuation of the machine logic activates the solenoid 20 to rotate track 18 clockwise and bring the blade into engagement with the photoreceptor surface 1 as illustrated in FIG. 4. Simultaneously with the activation of solenoid 20, the drive motor for the drum 1 is activated. It has been found that activation of solenoid 20 will occur more quickly than rotation of the photoreceptor drum 1 due to inertia and compliance in the photoreceptor drive; thus staggered activation of the solenoid and drive motor, with its attendant complications, is not necessary. In one specific embodiment, it has been found that the solenoid will act in 40–50 milliseconds with the photoreceptor beginning to rotate in 400–500 milliseconds. Following application of the blade 7 to the surface 1, the shaft 14 is rotated to return the blade, along the surface, to the normal cleaning position shown in FIG. 2. It will be noted that once the follower has passed the pivot 19, the solenoid may be disengaged since the spring-loaded follower 15 will hold the track in the desired, clockwise, position.

It will be understood that while a specific embodiment has been described, various modifications may be made without departing from the scope of the invention as defined in the appended claims. For example, a variation of the position where the blade 7 leaves the photoreceptor may be obtained by altering the position of pivot 19.

More uniform loading, when considering photoreceptor run-out, may be achieved by spring loading the blade within the cleaning blade assembly.

In FIG. 2 the track 18 has a curved profile which is preferred, but it may have a planar profile as shown in FIGS. 3 and 4.

What is claimed is:

1. A method of cleaning a surface by moving the surface in one direction relative to a cleaning blade in engagement therewith with rest periods of no relative motion wherein said blade is moved out of contact with the surface at a first position during a said period of no relative motion and returned thereto at a second position downstream of said first position.

2. A method as claimed in claim 1, including reversing the relative motion between the blade and the surface with the blade still in engagement with the surface prior to a said rest period.

3. A method as claimed in claim 2, in which the blade is moved across the surface in the downstream direction before it is moved out of contact with the surface.

4. A method as claimed in claim 3, in which the blade is pressed closer against the surface during said downstream movement than during cleaning.

5. A method as in claim 3, further including the steps of; forming a latent electrostatic image on said surface, developing the latent image with liquid developer, and transferring the developed image on to support material.

6. Apparatus for cleaning a surface including a cleaning blade engagable with said surface, drive means for moving the surface past the cleaning blade with rest periods of no relative motion, and blade translation means for moving the blade out of contact with the surface at a first position during a said period of no relative motion and for returning the blade into engagement with the surface at a second position downstream of said first position.

7. Apparatus as claimed in claim 6, in which the blade translation means comprises first means for moving the blade relative to the surface and second means for guiding the blade during movement.

8. Apparatus as claimed in claim 7, in which the guide means comprises a cam, and a mounting for the blade includes a follower which engages the cam.

9. Apparatus as claimed in claim 8, in which the cam is pivotally mounted intermediate its ends and the follower is biased against the cam such that the cam is urged to a first position in which the blade is engaged with the surface when the follower is to one side of the pivot and is urged to a second position in which the blade is disengaged from the surface when the follower is to the other side of the pivot.

10. Apparatus as claimed in claim 9, including a solenoid operative to move the cam into said first position.

11. Apparatus as claimed in claim 10, in which the blade is a scraper blade.

12. Apparatus as claimed in claim 10, in which the blade is a wiper blade.

13. An apparatus as in claim 12, wherein said cleaning apparatus comprises part of an electrostatographic reproducing machine further incorporating means for forming a latent electrostatic image on said surface, means for developing the latent image with liquid developer and means for transferring the developed image onto a support material.

* * * * *